US005244314A

United States Patent [19]

Calandra, Jr. et al.

[11] Patent Number: 5,244,314

[45] Date of Patent: Sep. 14, 1993

[54] EXPANSION ASSEMBLY

[75] Inventors: Frank Calandra, Jr., Pittsburgh, Pa.; Jerry E. Frease, Lexington, Ky.; John C. Stankus, Canonsburg, Pa.

[73] Assignee: Jennmar Corporation, Pittsburgh, Pa.

[21] Appl. No.: 722,125

[22] Filed: Jun. 27, 1991

[51] Int. Cl.[5] ..... E21D 20/02

[52] U.S. Cl. ..... 405/259.4; 405/259.6; 411/51

[58] Field of Search ..... 405/259.1, 259.3, 259.4, 405/259.5, 259.6; 411/49, 50, 51, 57, 63, 71, 72

[56] References Cited

U.S. PATENT DOCUMENTS

| | | | |
|---|---|---|---|
| Re. 31,776 | 12/1984 | Clark et al. | 405/261 |
| 2,685,221 | 8/1954 | Barrett | 85/2.4 |
| 3,181,414 | 5/1965 | Dickow | 411/72 X |
| 3,188,815 | 6/1965 | Schuermann et al. | 61/45 |
| 3,381,567 | 5/1968 | Askey | 85/75 |
| 3,941,028 | 3/1976 | Lebelle et al. | 85/73 |
| 4,160,614 | 7/1979 | Koval | 405/259 |
| 4,160,615 | 7/1979 | Baldwin | 405/259 |
| 4,162,133 | 7/1979 | Clark et al. | 405/258 |
| 4,173,918 | 11/1979 | Piersall | 85/75 |
| 4,193,715 | 3/1980 | Vass | 405/261 |
| 4,413,930 | 11/1983 | Calandra, Jr. | 405/261 |
| 4,419,805 | 12/1983 | Calandra, Jr. | 29/458 |
| 4,483,645 | 11/1984 | White et al. | 405/261 |
| 4,516,885 | 5/1985 | Calandra, Jr. | 405/261 |
| 4,516,886 | 5/1985 | Wright | 405/261 |
| 4,518,292 | 5/1985 | Calandra, Jr. | 411/82 |
| 4,534,679 | 8/1985 | White et al. | 405/261 |
| 4,611,954 | 9/1986 | Cassidy | 405/261 |
| 4,655,645 | 4/1987 | Hipkins, Sr. et al. | 405/261 |
| 4,664,561 | 5/1987 | Frease | 405/261 |
| 4,679,966 | 7/1987 | Yacisin | 405/261 |
| 4,764,055 | 8/1988 | Clark et al. | 405/261 |
| 4,784,530 | 11/1988 | Price | 405/259 |
| 4,913,593 | 4/1990 | Clark et al. | 405/261 |
| 4,969,778 | 11/1990 | Calandra et al. | 405/261 |
| 5,011,337 | 4/1991 | Clark et al. | 405/261 |

FOREIGN PATENT DOCUMENTS

| | | |
|---|---|---|
| 751137 | 1/1967 | Canada . |
| 2221267 | 11/1972 | Fed. Rep. of Germany . |

OTHER PUBLICATIONS

Frazer & Jones-"Mine Roof Support Anchors".

Frazer & Jones-"Two Great Names One Great System".

*Primary Examiner*—David H. Corbin

*Attorney, Agent, or Firm*—Stanley J. Price, Jr.

[57] ABSTRACT

An expansion assembly for use with resin on a mine roof bolt includes an expandable shell and a camming plug having a first end wall spaced from a second end wall by a tapered body portion. Four equidistantly spaced grooves extend longitudinally in the tapered body portion. Pairs of grooves are connected across the second end wall by transverse grooves that form resin flow channels. A rib formation extends outwardly from the side wall adjacent to and removed from a groove. The rib formation defines the edge of the groove and abuts an edge of one of the fingers of the expandable shell to align the grooves of the plug with the respective slots formed between the shell fingers. This alignment assures unobstructed flow of the mixed resin downwardly through the plug grooves and shell slots into surrounding relation with the expansion assembly for secure bonding of the assembly with the walls of a bore hole.

32 Claims, 2 Drawing Sheets

EXPANSION ASSEMBLY

BACKGROUND OF THE INVENTION

1. Field of the Invention

This invention relates to an apparatus for combining resin bonding and mechanical anchoring of a roof bolt apparatus in a bore hole of a rock formation and more particularly to an expansion assembly having a configuration adapted to facilitate the passage of resin from above the expansion assembly in a bore hole, down past and around the expansion assembly.

2. Description of the Prior Art

It is well known to reinforce and to stabilize underground roof formations, such as a coal mine roof, a subway tunnel or similar subterranean structure or to strengthen a rock mass by the use of anchor bolts inserted within a bore hole drilled in the rock formation. The anchor bolts are tensioned during installation to reinforce the unsupported rock formation above the roof, for example, of a mine passageway. Conventionally, a hole is drilled into the rock formation. The end of the bolt in the rock formation is anchored either by engagement of a mechanical expansion shell with the wall of the rock formation around the bore hole or chemically anchoring the bolt by a multi-component resin system or grout to the rock formation surrounding the bore hole.

The known devices utilize a resin bonding system in conjunction with a mechanical anchor assembly to both chemically and mechanically bond the roof bolt in the bore hole. A disadvantage of this system is that the diameter of the bore hole needed to accommodate the expansion assembly requires excessive amounts of resin, which increases costs significantly.

U.S. Pat. No. 4,764,055 discloses a mine roof bolt expansion assembly for use with resin having a specially configured, thin walled expansion shell together with a dual taper plug for expanding the shell. The shell and plug cooperate to provide a symmetrical array of resin passages at circumferentially spaced locations about the anchor assembly. A rib formation projects from the base of one of the groove like indentations on the outer surface of the plug. The rib projects outwardly into a slot between adjacent leaves or fingers of the shell. In this manner the indentations are aligned with slots in the expansion shell to provide the aforementioned resin flow passageways. Also the ribs serve to prevent unwanted rotation of the plug relative to the shell.

U.S. Pat. No. 2,685,221 discloses a mine roof bolt with a nut-receiving threaded end and a wedge end spaced therefrom having external threads thereon. A split sleeve is threaded onto the wedge end of the bolt and the threads move the wedge end of the bolt into the split sleeve to cause expansion thereof when the bolt is rotated.

U.S. Pat. No. 3,381,567 discloses a roof bolt with a first threaded end for receiving a bearing plate and a second threaded end for receiving a plug thereon for expanding the leaves of an expansion shell. The expansion shell comprises two shell portions which are semicircular in cross section held around the plug on the second threaded end by a plastic sheath. The shell portions have longitudinally extending slots for receiving opposed fins on the plug to prevent rotation of the plug relative to the expansion assembly.

U.S. Pat. No. 3,941,028 discloses a mine roof bolt with an expansion assembly comprising a plug surrounded by a plurality of fingers extending from an expansion shell. A retainer element maintains the expansion shell in proper position relative to the plug and comprises a stamped element with a threaded bore and extensions which frictionally engage the shell.

U.S. Pat. No. 4,160,614 discloses a mine roof bolt with an expansion shell assembly non-rotatably retained thereon in a given direction by an abutting portion of a clip member and releasably retained thereon by engagement of a releasing portion of the clip member when the bolt is rotated in the opposite direction.

U.S. Pat. No. 4,173,918 discloses a mine roof bolt having a threaded end with an expansion assembly thereon. The expansion shell is prevented from axial movement on the threaded end by a pin extending into a bore subjacent thereto. The expansion assembly has a wedge threadedly engaged to the first threaded end with the expansion shell comprising four leaves separated by slots extending from a base portion thereof. Ribs from the wedge extend into the slots to prevent movement of the plug relative to the shell.

U.S. Pat. No. 4,193,715 discloses a mine roof bolt for use with a resin system comprising a bar and a bolt joined by threaded ends thereof by a coupler. The bar has a shoulder which limits the extension of the threaded end thereof into the threaded coupler. The bar has a pair of nubs with a cylindrical collar positioned thereon between the coupler and the nubs. As the resin is mixed by the bar, it hardens to prevent further rotation of the bolt. Additional torque on the bolt breaks the nubs and/or collar to allow tensioning of the bolt by advancing a bearing plate into tension against the mine roof.

U.S. Pat. Nos. 4,483,645 and 4,534,679 disclose a mine roof bolt comprising a bolt portion with a headed end for securing a bearing plate and a threaded end threadedly received in an axial bore in a rebar portion. An expansion assembly is positioned subjacent the rebar and includes a plurality of expansion leaves connected by reduced neck portions to a base and a cone nut for expanding the leaves of the shell outwardly against the wall of the bore wall. The cone nut may have longitudinal grooves for receiving bail straps of a bail member to prevent rotation of the plug relative to the shell of the expansion assembly.

U.S. Patent No. 31,776 discloses a mine roof bolt having a means for controlling relative rotation between the expansion plug and the mine roof bolt in a given direction.

U.S. Pat. No. 4,611,954 discloses a mine roof bolt having a threaded end and a headed end. An expansion assembly is positioned on the threaded end and comprises an expansion shell with leaves extending toward the terminal end thereof from a base portion of the shell around a plug. The plug has an axial bore for threadedly engaging the threaded end of the mine roof bolt and a deformable plastic ring with an unthreaded bore securely engaged to an end wall of the plug. The threaded end of the plug cuts threads into the plastic ring when resistance to torque on the wedge exceeds the force required to cut the threads in the plastic ring.

U.S. Pat. No. 4,664,561 discloses a mine roof bolt having a threaded end opposite a headed end supporting a bearing plate. A hollow tube having a threaded nut welded to an end thereof is threaded onto the bolt threaded end and a conventional expansion shell plug is connected thereto above the hollow tube. The plug has grooves or channels on opposite sides thereof.

U.S. Pat. No. 4,679,966 discloses a mine roof bolt with a rod having threaded ends connected by a coupler to a bolt having a threaded end opposite a headed end. The threaded end of the rod opposite the coupler has an expansion assembly with a shell and a longitudinally grooved plug with a shear pin extending therethrough. The coupling also has a shear pin extending therethrough.

Canadian Patent No. 751,137 discloses a mine roof bolt with threaded ends spaced from each other by a shaft portion. The bolt has an expansion assembly at one end and a nut retained bearing plate at the other end. The expansion assembly consists of a split shell with a wedge plug for moving the shell into engagement with the wall of the bore hole. A threaded washer on the shoulder of the first threaded end holds the shell in position.

German Patent No. 22 21 267 discloses an expansion assembly with an expansion shell having four leaves axially extending from a base portion around a roof bolt. A wedge plug is threadedly engaged to the roof bolt and a portion thereof extends into the expansion shell. The shell is retained and positioned between the wedge plug and a snap ring which fits into a circular groove in the roof bolt.

A publication by Frazer & Jones entitled "Mine Roof Support Anchors" discloses expansion assemblies comprising plugs with longitudinal grooves therein aligned with slots between the leaves of an expansion shell connected by reduced neck portions to a base portion of the expansion shell.

Another publication by Frazer & Jones entitled "Two Great Names One Great System" discloses expansion shells with reduced neck portions and plugs with grooves therein aligned with the slots between leaves of expansion shells. A dual component resin system in cartridge form for use therewith is also disclosed.

Although the known devices utilize expansion shell assemblies having grooves in plugs aligned with slots between the leaves of an expansion shell, there remains a need for an expansion shell assembly that assures alignment of the grooves with the slots without obstruction of the grooves to the flow of resin in uniform surrounding relation with the expansion shell and in contact with the wall of the bore hole. The alignment of the grooves with the slots must be accomplished efficiently and maintained as the assembled shell and plug is advanced into position for mixing of the resin components and expansion of the shell in the bore hole.

SUMMARY OF THE INVENTION

In accordance with the present invention, there is provided an expansion shell assembly for anchoring a bolt in a bore hole containing adhesive material that includes an expansion shell having a circular base portion and a plurality of longitudinally extending fingers equally spaced from one another forming elongated slots therebetween. Each finger is formed integral at one end portion with the base portion and extends upwardly therefrom to form a free end portion for outward expansion of the finger. The fingers each have an inner surface and an outer surface for frictionally engaging the wall of the bore hole. A plug member has a threaded axial bore for engaging the end of the bolt, an upper end portion, a lower end portion, and a surrounding side wall tapering downwardly from said upper end portion to said lower end portion. The inner surface of the fingers abut the plug member side wall. A plurality of grooves extend longitudinally on the plug member side wall. The grooves are spaced equally from one another on the side wall. Alignment means extend from the plug member side wall adjacent to a selected groove for engaging the edge of one of the fingers to align the groove with the slots between the fingers respectively. Stop means prevents relative axial movement between the shell and the plug member during mixing of adhesive material in the bore hole. The stop means is releasable after mixing of the adhesive material to permit rotation of the bolt relative to the plug member to advance the plug member on the bolt and exert an outward force upon the inner surfaces of the fingers to expand the fingers in the bore hole and anchor the bolt.

Further in accordance with the present invention, there is provided a method for anchoring a bolt in a bore hole that includes the steps of inserting adhesive material for mixing in a bore hole. An elongated bolt having an assembled expansion shell and plug member positioned on the end thereof is advanced into the bore hole. The bolt and the expansion shell assembly are rotated to effect mixing of the adhesive material in the bore hole. Relative axial movement is prevented between the expansion shell and plug member during mixing of the adhesive material. Flow of mixed adhesive material is directed downwardly in the grooves on the surface of the plug member. A protuberance on the plug member offset from a corresponding groove abuts the edge of a finger of the expansion shell to align the plug member grooves with the slots between the fingers of the expansion shell to provide flow of adhesive material in surrounding relation with the expansion shell assembly and in contact with the bore hole wall. The fingers of the expansion shell expand into gripping engagement with the bore hole wall to anchor the bolt in the bore hole.

Additionally, the present invention is directed to a plug member for an expansion shell assembly that includes a tapered body portion having a threaded axial bore therethrough. The body portion has an enlarged upper end portion and a reduced lower end portion. An annular side wall extends around the body portion between the upper and lower end portions. A plurality of channels extend longitudinally in the surface of the side wall between the upper and lower end portions. The channels are equally circumferentially spaced from one another on the annular side wall. A protuberance extends outwardly from the annular side wall and is offset from an adjacently positioned channel.

Accordingly, the principal object of the present invention is to provide an expansion shell assembly for use with a resin bonding system that assures rapid and efficient alignment of the resin flow passages formed in the assembly into surrounding relation with the assembly and in contact with the wall of the bore hole.

Another object of the present invention is to provide an expansion shell assembly for combined mechanical and resin anchoring of a bolt in a mine roof in which the grooves of the expansion plug-remain aligned with the slots between the fingers of the expansion shell without obstructing the grooves to the flow of resin downwardly and into surrounding relation with the shell.

A further object of the present invention is to provide ribs or protuberances on the camming plug of an expansion shell assembly which are offset from the resin flow grooves of the plug, which protuberances serve as stops to engage the sides of the expansion shell fingers when the grooves in the plug are aligned with the slots between the fingers.

Another object of the present invention is to provide means removed from the resin flow passages in the camming plug of an expansion shell assembly that serve the dual purpose of maintaining the slots between the expansion shell fingers aligned with the resin flow passageways in the plug and prevent unwanted rotation of the plug in the shell.

These and other objects of the present invention will be more completely disclosed and described in the following specification, the accompanying drawings and the appended claims.

DESCRIPTION OF THE PREFERRED EMBODIMENTS

Figure 1:
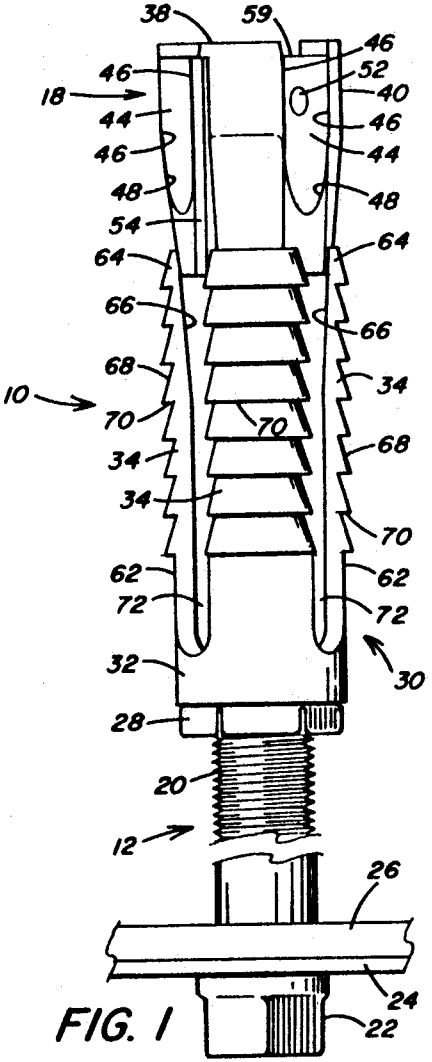
FIG. 1 is a view in side elevation of the expansion assembly of the present invention.

Referring to the drawings, and particularly to FIGS. 1–6, there is illustrated an expansion shell assembly generally designated by the numeral 10 for use with a roof bolt or rock bolt generally designated by the numeral 12 for insertion in a bore hole 14 of a rock formation 16 (shown in FIGS. 7–9) to support the rock formation 16. The rock formation 16 can include, for example, a mine roof that overlies a mine passageway or shaft, a subway tunnel, or other similar subterranean structure.

Figure 7:
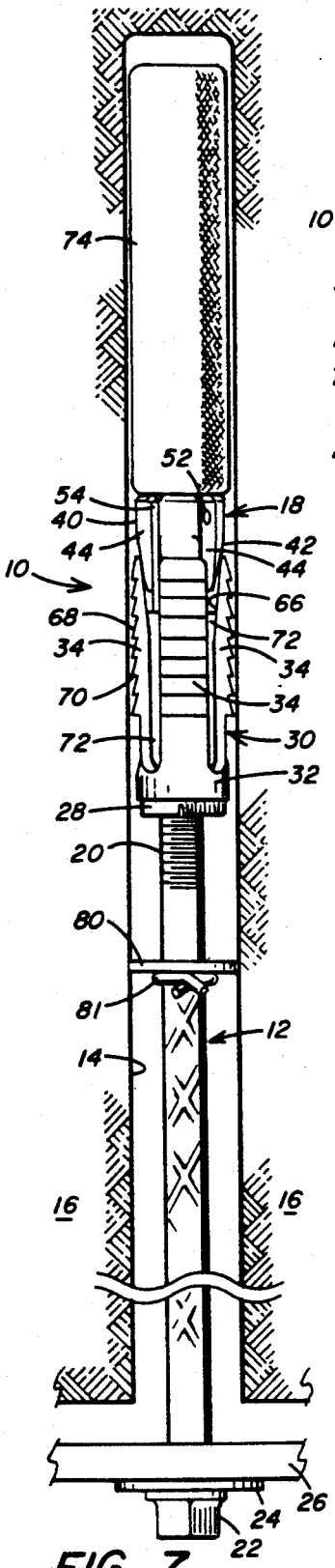
FIG. 7 is a view in side elevation of the expansion assembly of the present invention positioned on a mine roof bolt, illustrating a resin cartridge advanced ahead of the expansion assembly in the bore hole.
Figure 8:
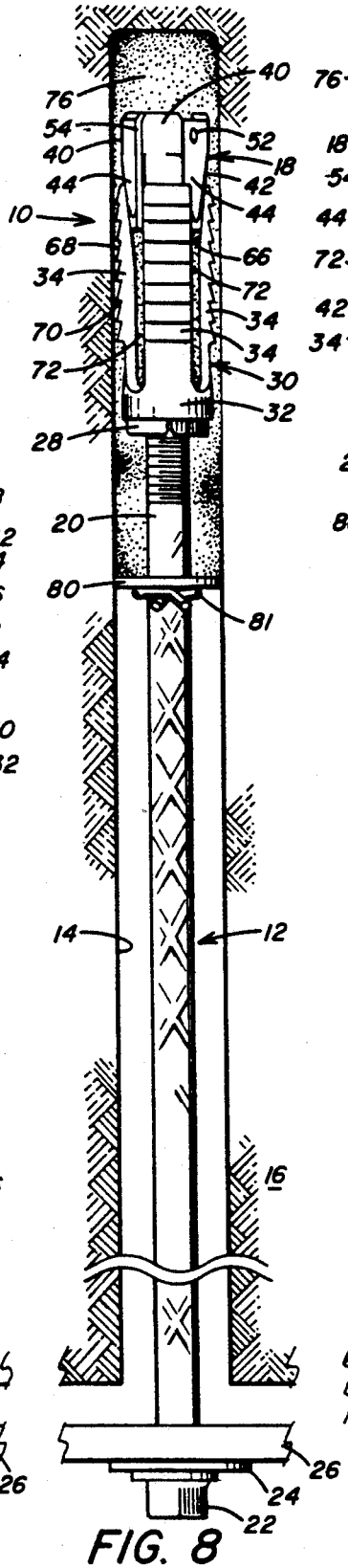
FIG. 8 is another view in side elevation of the expansion assembly, illustrating rupture of the resin cartridge and mixing of the resin components in the bore hole.
Figure 9:
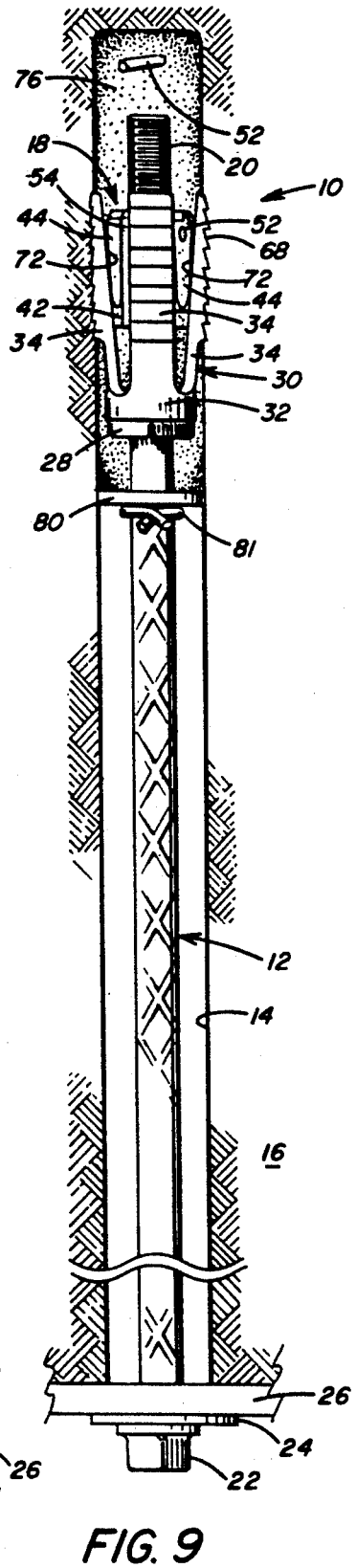
FIG. 9 is another view in side elevation of the expansion assembly, illustrating expansion of the shell into contact with the wall of the bore hole prior to setting of the resin.

Expansion shell assembly 10 includes a camming plug generally designated by the numeral 18 threadedly received on the threaded end 20 of mine roof bolt 12. Mine roof bolt 12 includes a headed end 22 having a configuration adapted to rotate mine roof bolt 12 when headed end 22 is connected to a bolting machine (not shown). Headed end 22 has a washer 24 between headed end 22 and a bearing plate 26. Bearing plate 26 has a configuration adapted to compressingly contact the rock formation 16 as shown in FIGS. 7–9, when mine roof bolt 12 is anchored and tensioned in bore hole 14.

Expansion assembly 10 is installed on mine roof bolt 12 by placing a circular jam nut or pal nut 28 over the threaded end 20 of mine roof bolt 12. Thereafter an expansion shell generally designated by the numeral 30 is positioned on bolt 12 such that an annular base portion 32 abuts the pal nut 28 and axially extending fingers or leaves 34 surround the threaded end 20 of mine roof bolt 12. Camming plug 18 is then threadedly advanced on the threaded end 20 of mine roof bolt 12 into the expansion shell 30.

The camming plug 18 is shown in greater detail in FIGS. 2–5 and includes a first end wall 36 connected to a second end wall 38 by a straight side wall portion 40 connected at an angle of about 90° to the second end wall. An angled side wall 42 extends between straight side wall 40 and first end wall portion 36 at an angle of approximately 6.5° to the longitudinal axis of straight side wall 40. Plug 18 also has four equidistantly spaced grooves 44 extending longitudinally from end wall 38 through straight side wall 40 parallel to the longitudinal axis of plug 18 and partially along and merging into angled side walls 42. Grooves 44 may vary in depth between one another.

Grooves 44 of the camming plug 18 are defined by side walls 46 and curved end walls 48. A bore 50 extends through plug 18 transversely to the longitudinal axis thereof and into a pair of diametrically opposed grooves 44. Transverse bore 50 has a shear pin 52 extending therethrough as illustrated in FIGS. 1, 4 and 5.

Figure 2:
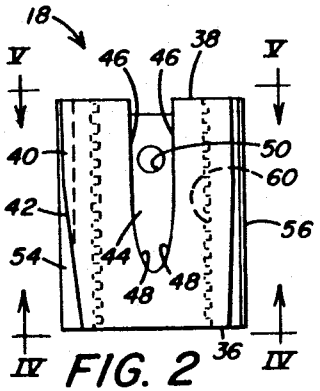
FIG. 2 is a view in side elevation of the plug member, illustrating a pair of ribs projecting outwardly from the surface of the plug member and a longitudinal bore shown in phantom.
Figure 3:
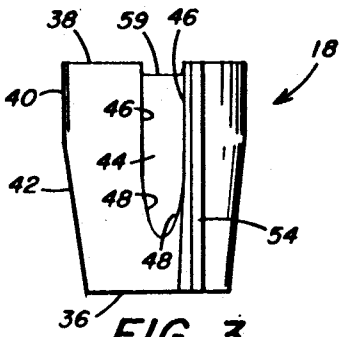
FIG. 3 is a view in side elevation of the plug member similar to FIG. 2, illustrating one of the ribs positioned offset from the resin flow groove in the plug member.
Figure 4:
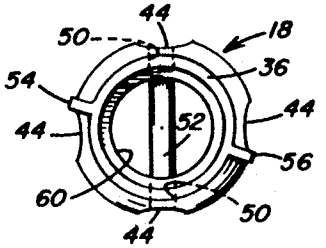
FIG. 4 is a bottom plan view of the plug member shown in FIG. 2, illustrating the pair of oppositely positioned ribs.

As illustrated in FIGS. 2–4, a pair of diametrically opposed protuberances or rib-like formations 54 and 56 extend from angled side wall 42. The ribs 54 and 56 are positioned parallel to side walls 46 of the grooves 44 and extend in length along the angled side wall 42 and straight side wall 40 from the first end wall 36 to the second end wall 38. The ribs 54 and 56 are thus removed or offset from the grooves 44 and do not obstruct the flow of mixed resin downwardly in the grooves 44 as will be explained later in greater detail.

The ribs 54 and 56 are closely positioned adjacent to the grooves 44 and thereby form one edge which defines the adjacently positioned groove 44. Rib formations 54 and 56 protrude outwardly from the sidewall of plug 18 as seen in FIG. 5 and thereby serve as longitudinally extending shoulders laterally displaced or offset from the longitudinal axis or the center of each of the grooves to both align groove 44 with slots between shell leaves 34 and prevent rotation between plug 18 and expansion shell 30, as will be hereinafter explained in greater detail.

Figure 5:
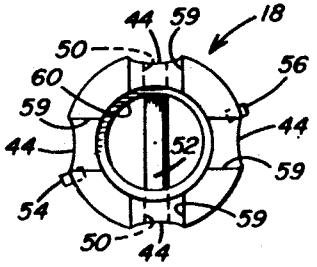
FIG. 5 is a top plan view of the plug member shown in FIG. 2, illustrating a shear pin extending transversely through the axial bore.

As illustrated in FIG. 5, oppositely positioned grooves 44 are connected across second end wall 38 of plug 18 by transverse horizontal grooves 59 which combine with the vertical grooves 44 to form passageways for the flow of resin in surrounding relation with plug 18. Plug 18 also includes an axially extending threaded bore 60 for threadedly receiving the threaded end 20 of mine roof bolt 12.

Figure 6:
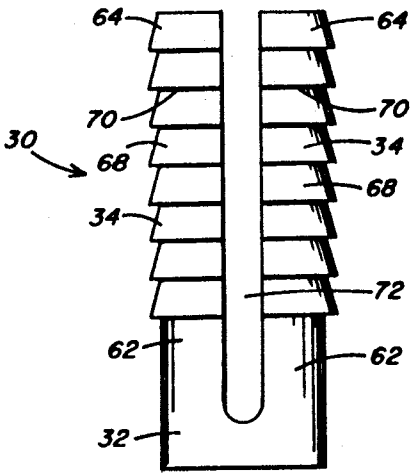
FIG. 6 is a view in side elevation of the expansion shell of the present invention.

As shown in FIGS. 1 and 6, expansion assembly 10 also includes an expansion shell 30 including four leaves or expansion fingers 34 extending axially around the threaded end 20 of mine roof bolt 12 from an integral annular base portion 32. Each leaf 34 has a first end portion 62 integrally connected to annular base 32 and a second or free end portion 64 spaced therefrom. Further, each leaf 34 has an inner surface 66 defining an axially extending bore through expansion shell 30 and an outer surface 68.

The inner surface 66 at the free end portion 64 of each leaf 34 tapers outwardly relative to the longitudinal axis of the leaf 34 at an angle of approximately 6° as best illustrated in FIG. 1. The inner surface 66 of each leaf 34 receives the angled side wall 42 of plug 18 when the expansion assembly 10 is positioned on threaded end 20 of mine roof bolt 12. Outer surface 68 of each leaf 34 has horizontal serrations 70 for gripping engagement with the wall of the bore hole 14 when the plug 18 moves downwardly on the threaded end 20 of mine roof bolt 12. The plug 18 advances on the bolt 12 when torque is applied thereto through the headed end 22 thereof while the expansion shell 30 is prevented from longitudinal movement along bolt 12 by jam nut 28. Jam nut 28 has a smaller outside dimension than annular base 32 such that jam nut 28 does not impede the flow of resin down, past and around expansion assembly 10.

Leaves 34 of expansion shell 30 are separated from one another by slots 72 as illustrated in FIGS. 1 and 4. In accordance with the present invention, rib formations 54 and 56 protrude outwardly from the surface of the plug 18 into slots 72 and abut the side edges of the leaves 34 as shown in FIGS. 1 and 7-9. With this arrangement, the ribs 54 and 56 act as shoulders to receive in abutting relation the lateral edges of the respective leaves 34. Because the ribs 54 and 56 are offset and removed from the immediate areas of the grooves 44, alignment of the grooves 44 with the slots 72 occurs automatically upon insertion of the plug 18 in the shell 30 and rotation of the plug until a respective one of the ribs 54 and 56 abuts the side of a leaf. In this manner, it is not necessary to visually align the plug grooves 44 with the shell slots 72. Alignment is efficiently accomplished by inserting the plug 18 in the shell 30 and rotating the plug relative to the shell until the plug is restrained from further rotation by contact of a rib 54, 56 with a leaf 34. At this point, proper alignment of grooves 44 with slots 32 is attained. Contact of the ribs 54 and 56 with the leaves 34 prevents unwanted rotation of the plug 18 in the shell 30. This further assures alignment of grooves 44 and slots 32 during mixing of the resin components and flow of the mixed resin through the resin flow channels formed by the plug grooves 44 and 59 and shell slots 72. The combined width of a groove 44 and adjacent rib 54, 56 is less than the width of a shell slot 72 so that the width of the resin flow channels is not less than the width of the grooves 44 or slots 72.

As seen in FIGS. 2 and 3, rib formations 54 and 56 extend the length of the plug 18 and project outwardly from the straight side wall 40 and angled side wall 42 of the plug 18 to form one edge of the plug grooves 44. Because the ribs 54 and 56 are not located within the grooves 44, they do not impede the flow of resin through grooves 44. The rib formations 54 and 56 maintain grooves 44 aligned with slots 72. The aligned grooves 44 and slots 72 form the resin channels in expansion assembly 10. The open resin channels facilitate resin flow downwardly, past and around expansion shell assembly 10 with less resistance in a smaller diameter bore hole 14 than would be required for an unmodified expansion shell assembly. The transverse grooves 59 in second end wall 38 of plug 18 also provide clearance for the unimpeded flow of resin past plug 18. Since the outer dimension of circular jam nut 28 is smaller than the outer diameter of the annular base 32 of expansion shell 30, circular jam nut 28 does not impede the flow of resin down, past and around expansion shell assembly 10.

As illustrated in FIGS. 7-9, expansion shell assembly 10 is assembled on the threaded end 20 of a mine roof bolt 12 by passing jam nut 28 thereover. Thereafter bolt threaded end portion 20 is extended through annular base portion 32 of expansion shell 30. Plug 18 is threadedly advanced onto the bolt threaded end 20 with the plug first end wall 36 positioned adjacent expansion shell 30. A portion of plug angled side wall 42 extends into contact with leaves 34. The rib formations 54 and 56 are advanced into abutting relation with the lateral edges of the shell leaves 34 so that the plug grooves 44 and shell slots 72 are in alignment. Contact of the ribs with the leaves not only maintains the grooves 44 and slots 72 aligned but also assures that the inner surface 66 of each leaf 34 bears completely upon the plug side wall 40. In this manner, the plug applies a uniform outward, expansion force on the shell leaves as the shell is expanded. The leaves do not experience concentrated loading which occur when the leaves 34 overlap the grooves 44. The above described alignment feature prevents this concentrated loading.

Referring to FIG. 7, a dual component resin cartridge generally designated by the numeral 74 is utilized and includes a polyester resin and a catalyst or hardener in separated compartments. The separate compartments are contained in a single package which is inserted into the bore hole 14 ahead of the mine roof bolt 12 having the assembled expansion assembly 10 positioned thereon. As illustrated in FIG. 8, resin cartridge 74 is fractured by the insertion of mine roof bolt 12 into the bore hole. The headed end 22 of bolt 12 is rotated by a bolting machine (not shown) to mix the resin and the catalyst components to form the mixed resin 76. Washer 80 may be positioned along bolt 12 by a retaining means, such as clamp 81, to prevent egress of the mixed resin 76 from the vicinity of the expansion shell 10 when the resin cartridge 74 is fractured thereby. As the bolt 12 rotates, the shear pin 52 serves as a stop to prevent relative rotation between the bolt 12 and the plug 18. Consequently, relative axial movement between the shell 30 and plug 18 is prevented during mixing of the resin and the catalyst in the bore hole.

As illustrated in FIG. 9, as the resin mixture begins to harden, increased friction is placed upon expansion shell assembly 10 such that the resistance to torque applied to headed end 22 of bolt 12 exceeds the material strength of shear pin 52. Shear pin 52 is sheared by the threaded end 20 of bolt 12 to allow longitudinal movement of plug 18 downwardly on the threaded end 20 of bolt 12. As plug 18 moves downwardly on threaded end 20 and as expansion shell 30 is prevented from longitudinal movement by jam nut 28, camming plug 18 remains in full contact with the inner surfaces 66 of the leaves 34 to force leaves 34 radially outwardly into gripping engagement with the wall of the bore hole 14.

As described above, plug grooves 44 are maintained in alignment with shell slots 72 by abutment of ribs 54 and 56 with the lateral edges of the respective leaves 34. Consequently, the flow of mixed resin 76 downwardly, past and around expansion shell assembly 10 is relatively unimpeded. Additionally, grooves 44 are connected to transverse grooves 59 in second end wall 38 to allow resin to flow from above plug 18 along transverse grooves 59 and into grooves 44. Thus, bore holes having a smaller diameter may be utilized with the modified expansion shell of the present invention such that the annulus provided between the expansion shell assembly 10 and the wall of the bore hole 14 is less than that provided with unmodified or conventional expansion assemblies when used with resin systems. By using the modified expansion shell assembly 10 of the present invention with a smaller diameter bore hole 14, a significant reduction in the quantity of resin utilized with the expansion assembly 10 is realized with a concomitant reduction in cost.

According to the provisions of the Patent Statutes, we have explained the principle, preferred construction and mode of operation of our invention and have illustrated and described what we now consider to represent its best embodiments However, it should be understood that within the scope of the appended claims, the invention may be practiced otherwise than as specifically illustrated and described.

We claim:

1. An expansion shell assembly for anchoring a bolt in a bore hole containing adhesive material comprising, an expansion shell having a circular base portion and a plurality of longitudinally extending fingers spaced from one another forming elongated slots therebetween, said fingers each formed integral at one end portion with said base portion and extending upwardly therefrom to form a free end portion for outward expansion of said fingers, said fingers each having an inner surface and an outer surface, said outer surfaces of said fingers adapted to frictionally engage the wall of the bore hole, a plug member having a threaded axial bore for engaging the end of the bolt, an upper end portion, a lower end portion, and a surrounding sidewall tapering downwardly from said upper end portion to said lower end portion, said inner surfaces of said fingers abutting said plug member sidewalls, a plurality of grooves extending longitudinally on said plug member sidewall and each of said grooves including a longitudinal axis, said grooves being spaced from one another on said sidewall and positioned uniformly around said sidewall, alignment means extending from said plug member sidewall and laterally displaced from said longitudinal axis of at least one of the grooves for engaging the edge of at least one of said fingers to align said grooves with said slots between said fingers respectively and maintain said inner surfaces of said fingers abutting said plug member sidewall, said slots of said shell positioned oppositely of said grooves of said plug to provide a plurality of pairs of slots and grooves to form a plurality of open resin flow channels, said open resin flow channels being uniformly spaced from one another around the entire periphery of the expansion shell assembly, and said alignment means maintaining said grooves aligned with said slots to maintain said resin flow channels open to facilitate resin flow downwardly, past the expansion shell assembly and uniformly distributed around the expansion shell assembly.

2. An expansion shell assembly as set forth in claim 1 which includes, means for maintaining said inner surfaces of said fingers in contact with said plug member sidewall to distribute the forces applied by said plug member uniformly over said inner surfaces.

3. An expansion shell assembly as set forth in claim 2 which includes, a shoulder extending outwardly from said plug member sidewall and defining a lateral edge of one of said grooves on said plug member, and said shoulder positioned in abutting relation with the edge of one of said fingers to position the inner surface of each of said fingers in contact with said plug member sidewall and removed from position overlying said grooves.

4. An expansion shell assembly as set forth in claim 1 in which, said plug member sidewall includes a top portion extending downwardly at a right angle with respect to said second end wall, a bottom portion extending at an obtuse angle with respect to said first end wall, and said bottom portion intersecting said top portion to form said plug member having a cylindrical portion and a tapered portion.

5. An expansion shell assembly as set forth in claim 1 wherein, said alignment means includes a first rib formation defining an edge of one of said plug member grooves and a second rib formation defining an edge of a second of said plug member grooves, said first and second rib formations extending a preselected length on said plug member side wall and protruding outwardly therefrom oppositely of an adjacently positioned pair of said fingers, and said rib formations abutting said fingers to prevent rotation of said plug member relative to said shell.

6. An expansion shell assembly as set forth in claim 5 in which, said rib formation maintains said fingers removed from overlying relation with said grooves to maintain said inner surfaces of said fingers in full bearing contact with said plug member sidewall.

7. An expansion shell assembly as set forth in claim 1 in which, said alignment means includes a protuberance extending outwardly from said plug member sidewall in parallel relation with a selected one of said grooves to form an edge of said groove.

8. An expansion shell assembly as set forth in claim 1 which includes, a tapered portion of said plug member side wall, said tapered portion extending from said lower end portion a preselected length up said sidewall, said tapered portion terminating on said sidewall a distance spaced from said upper end portion, and said alignment means extending on said side wall substantially the length of said tapered portion forming an edge of a selected one of said plug member grooves.

9. An expansion shell assembly as set forth in claim 1 in which, said alignment means includes a longitudinally extending rib displaced from said groove to impede further rotation of said plug member relative to said shell when said grooves are aligned with said slots upon contact of said rib with an adjacently positioned one of said fingers.

10. A method for anchoring a bolt in a bore hole comprising the steps of:

inserting adhesive material for mixing in a bore hole, advancing an elongated bolt having an assembled expansion shell and plug member positioned on the end thereof into the bore hole, rotating the bolt and the expansion shell assembly to effect mixing of the adhesive material in the bore hole, preventing relative axial movement between the expansion shell and plug member during mixing of the adhesive material, directing flow of mixed adhesive material downwardly in grooves on the surface of the plug member, displacing at least one protuberance on the plug member laterally from a longitudinal axis of one of the grooves, abutting the protuberance on the plug member with the edge of one of the fingers of the expansion shell to align uniformly around the expansion shell assembly each plug member groove with a corresponding slot between the fingers of the expansion shell so that the fingers are removed from overlapping relation with the grooves to form a plurality of open resin flow channels uniformly positioned around the expansion shell assembly to provide unimpeded flow of the adhesive material uniformly distributed around the expansion shell assembly and in contact with the bore hole wall, and forming the open resin flow channels by the alignment of each the plug member grooves with each of the slots between the fingers of the expansion shell to provide a plurality of aligned pairs of grooves and slots to promote resin flow downwardly, past and around the entire periphery of the expansion shell assembly, and expanding the fingers of the expansion shell into gripping engagement with the bore hole wall to anchor the bolt in the bore hole.

11. A method as set forth in claim 10 which includes, inserting the plug member within the expansion shell, positioning bearing surfaces of the expansion shell leaves in contact with the side wall of the plug member, and maintaining the bearing surfaces of the expansion shell leaves removed from overlying relation with the grooves in the plug member so as to distribute the expansion forces applied by the plug member to the shell uniformly over the bearing surfaces of the leaves.

12. A method as set forth in claim 11 which includes, obstructing movement of the expansion shell leaves into overlying relation with the plug member grooves upon movement of the protuberance on the plug member into contact with the edge of the expansion shell finger.

13. A method as set forth in claim 10 which includes, extending the protuberance parallel to the groove to form a rib formation positioned longitudinally on the plug member removed from the groove.

14. A method as set forth in claim 13 which includes, defining an edge of the groove by the rib formation extending the length of the plug member.

15. A method as set forth in claim 10 which includes, preventing relative rotation between the plug member and the expansion shell upon contact of the protuberance with the edge of the fingers of the expansion shell.

16. A plug member for an expansion shell assembly comprising, a tapered body portion having a threaded axial bore therethrough, said body portion having an enlarged upper end portion and a reduced lower end portion, an annular sidewall extending around a periphery of said body portion between said upper and lower end portions, a plurality of channels extending longitudinally in the surface of said sidewall between said upper and lower end portions, said channels being uniformly spaced from one another on said annular sidewall around the entire periphery of said body portion and each channel having a longitudinal axis, said channels forming a plurality of open paths around said body portion to facilitate the uniform distribution and flow of resin downwardly, past and around the periphery of said body portion, and at least one protuberance extending outwardly from said annular sidewall and offset from said longitudinal axis of an adjacently positioned one of said channels.

17. A plug member as set forth in claim 16 which includes, said protuberance defining an edge of said channel and therefore removed from said channel.

18. A plug member as set forth in claim 16 which includes, a pair of said protuberances extending parallel to and laterally offset from the longitudinally axes of a pair of said channels respectively.

19. A plug member as set forth in claim 16 in which, said protuberance includes a rib formation extending the length of said tapered body portion laterally displaced from said longitudinal axis of said channel.

20. A plug member as set forth in claim 19 in which, said rib formation forms an edge of said channel on said body portion.

21. An expansion shell assembly for anchoring a bolt in a bore hole containing adhesive material comprising, an expansion shell having a circular base portion and a plurality of longitudinally extending fingers equally spaced from one another forming elongated slots therebetween, said fingers each formed integral at one end portion with said base portion and extending upwardly therefrom to form a free end portion for outward expansion of said fingers, said fingers each having an inner surface and an outer surface, said outer surface of said fingers adapted to frictionally engage the wall of the bore hole, a plug member having an axial bore for receiving the end of the bolt, an upper end portion, a lower end portion, and a surrounding sidewall tapering downwardly from said upper end portion to said lower end portion, said inner surfaces of said fingers abutting said plug member sidewall, said plug member sidewall including a straight portion and an angled portion, said straight portion extending from said plug member upper end portion and said angled portion extending from said plug member lower end portion, a plurality of grooves extending longitudinally on said plug member sidewall, said grooves being spaced from one another on said sidewall, and said grooves extending from said plug member upper end portion through said straight portion and partially along and merging into said angled portion at a point on said sidewall spaced from said plug member lower end portion.

22. An expansion shell assembly as set forth in claim 21 in which, said angled portion of said plug member sidewall extends at an angle of at least 6.5° from said straight portion of said plug member sidewall.

23. An expansion shell assembly as set forth in claim 21 which includes, alignment means extending from said plug member sidewall for engaging an edge of at least one of said fingers to align said grooves with said slots between said fingers respectively and maintain said inner surfaces of said fingers abutting said plug member sidewall.

24. An expansion shell assembly as set forth in claim 23 in which, each of said grooves includes a longitudinal axis, and said alignment means extending parallel to said longitudinal axis of at least one of said grooves.

25. An expansion shell assembly as set forth in claim 23 in which, said alignment means includes a first rib formation positioned in parallel relation with one of said grooves and a second rib formation positioned in parallel relation with a second of said grooves, and said first and second rib formation extending a preselected length on said plug member sidewall and protruding outwardly therefrom oppositely of an adjacently positioned pair of said fingers.

26. An expansion shell assembly as set forth in claim 21 in which, each of said grooves is defined by a pair of longitudinal walls extending substantially parallel to said plug member sidewall straight portion and a pair of curved end walls, and said curved end walls extend from said longitudinal walls to a closed end portion of said respective groove merging into said plug member sidewall angled portion.

27. A plug for use with a mine roof bit expansion assembly comprising, a body portion having an axial bore for receiving the end of a mine roof bolt, said body portion including an upper end portion, a lower end portion, and a surrounding sidewall tapering downwardly from said upper end portion to said lower end portion, said sidewall including a straight portion and an angled portion, said straight portion extending from said upper end portion and said angled portion extending from said lower end portion, a plurality of grooves extending longitudinally on said sidewall, said grooves being spaced from one another on said sidewall, and said grooves extending from said upper end portion through said straight portion and partially along and merging into said angled portion at a point on said sidewall spaced from said lower end portion.

28. A plug as set forth in claim 27 in which, said angled portion of said body portion sidewall extends at an angle of at least 6.5° from said straight portion of said body portion sidewall.

29. A plug as set forth in claim 27 which includes, alignment means extending from said sidewall for engaging an edge of at least one of a plurality of fingers of the mine roof bolt expansion assembly to align said grooves with slots between the fingers respectively.

30. A plug as set forth in claim 29 in which, each of said grooves includes a longitudinal axis, and said alignment means extending parallel to said longitudinal axis of at least one of said grooves.

31. A plug as set forth in claim 29 in which, said alignment means includes a first rib formation positioned in parallel relation with one of said grooves and a second rib formation positioned in parallel relation with a second of said grooves, and said first and second rib formations extending a preselected length on said sidewall and protruding outwardly therefrom.

32. A plug as set forth in claim 27 in which, each of said grooves is defined by a pair of longitudinal walls extending substantially parallel to said sidewall straight portion and a pair of curved end walls, and said curved end walls extend from said longitudinal walls to a closed end portion of said respective groove merging into said sidewall angled portion.

* * * * *